US007607863B2

(12) United States Patent
Paull

(10) Patent No.: US 7,607,863 B2
(45) Date of Patent: Oct. 27, 2009

(54) AUTOMATED PIPE-LAYING METHOD AND APPARATUS

(76) Inventor: Philip Paull, 6787 E. 171st St., Noblesville, IN (US) 46062

( * ) Notice: Subject to any disclaimer, the term of this patent is extended or adjusted under 35 U.S.C. 154(b) by 407 days.

(21) Appl. No.: 11/275,907

(22) Filed: Feb. 2, 2006

(65) Prior Publication Data

US 2007/0177945 A1 Aug. 2, 2007

(51) Int. Cl.
*F16L 3/00* (2006.01)

(52) U.S. Cl. ..... 405/179; 405/181; 405/174; 405/175

(58) Field of Classification Search ..... 405/157, 405/179, 180, 181, 175, 174, 184
See application file for complete search history.

(56) References Cited

U.S. PATENT DOCUMENTS 3,820,345 A 6/1974 Brecht
4,289,424 A 9/1981 Shefbuch et al.
4,362,435 A * 12/1982 Henry ..... 405/184.5
4,363,594 A 12/1982 Morin
4,741,646 A 5/1988 Hatch
4,981,396 A 1/1991 Albertson et al.
5,145,290 A * 9/1992 Wise ..... 405/179
5,174,685 A 12/1992 Buchanan
5,707,175 A 1/1998 Geelhoed

* cited by examiner

*Primary Examiner*—David J Bagnell
*Assistant Examiner*—Sean D Andrish
(74) *Attorney, Agent, or Firm*—C. John Brannon; Brannon & Associates PC

(57) ABSTRACT

A trench box, including a pair of oppositely disposed parallel elongated sidewalls defining a work volume, distal and proximal support members extending between the sidewalls, and a track positioned between the sidewalls. Track adjusting members extend between the track and the support members and a movable tram connecting plate is connected to the track. An actuator is coupled to the track and energizable to move the tram connecting plate and a tool module is operationally connectable to the tram connecting plate. A pipe dispensing assembly and a gravel hopper assembly are positionable within the working volume.

25 Claims, 10 Drawing Sheets

AUTOMATED PIPE-LAYING METHOD AND APPARATUS

TECHNICAL FIELD OF THE INVENTION

The present invention relates generally to excavation and construction, and more particularly to a modular trench box device and methods for using the same to lay pipe in an excavated trench.

BACKGROUND OF THE INVENTION

Laying pipe or conduit in excavated trenches is an inherently dangerous task. Even in relatively stable ground, there is always a risk that the trench walls may collapse and injure or kill workmen in the trench. Further, even if such collapses do not cause injury, time and effort are lost when the trench has to be redug. These risks of collapse increase with the depth of the trench, which may range from five or six feet to 25-30 feet or more. The risks are even greater if the ground contains is especially rocky and/or wet and/or contains other like obstacles.

Various safety devices have been developed address these issues. Perhaps the most common such device is the trench box. A trench box is simply a large hollow floorless rectangular box with a pair of parallel elongated sidewalls connected by either by narrow front and back walls or support members called "spreaders". The trench box is sized to fit into the trench being dug to shore up the walls and prevent its collapse while workmen lay pipe therein. The trench box is typically made of a structural material, such as steel, of sufficient thickness to hold its shape even when the trench walls begin to collapse in on it. Typically, an excavating machine, such as a trackhoe, is used to excavate a trench in advance of the trench box. The trench is made slightly wider than the trench box. Once the pipe is laid at the bottom of the trench within the trench box, the trench box may be pulled forward into a newly dug trench portion for continuing the pipe-laying procedure. When a deep trench is required, the trench boxes are merely stacked one on top of the other until the desired height is reached.

One alternative to using a trench box is to slope the walls of the trench back at an angle of repose such that the walls are not likely to collapse into the trench. This means that the excavator must remove considerably more earth from the trench, adding time and expense to the job. Another alternative is to simply dig the trench and work within as is—an option that is still popular with some excavators.

In addition to the safety issues, there are other problems complicating the task of laying pipe in excavated trenches. For example, each section of pipe must be properly aligned to fit into the pre-existing laid pipe. Further, it is often necessary to deal with obstacles such as damaged pipe sections or fittings, rocks, and the like; dealing with such obstacles takes time and often requires specialized tools. Often, these tools are bulky and the use of such specialized tools requires removal of the trench box and a widening of the trench to accommodate the tools. This adds time and risk to the job.

Also, there is typically no mechanism for depositing gravel or stone filler material over the laid pipe. Further, it remains difficult to maintain the grade and alignment of the conduit being laid in the trench. In the past, this was done almost always done manually via best-guess work and estimation; currently, lasers are used to assist in alignment. Moreover, it is time consuming, if not especially difficult, for the operator to lower the pipe into the trench and/or position the pipe.

Thus, there remains a need for an improved bracing box for laying pipe in a trench. The present invention addresses this need.

SUMMARY OF THE INVENTION

The present invention relates to a bracing box system for laying and fitting pipe in a trench and includes an elongated box defined by a pair of elongated parallel walls of height sufficient to extend from ground level to the bottom of the trench (typically about 25 feet) joined at the bottom by a pair of support members extending therebetween. Relatively narrow posterior and anterior walls or support members extend between the elongated sidewalls, with the anterior and posterior walls typically having arch-shaped openings at the bottom to accommodate the extension of pipe therethrough. An adjustable leveling skid assembly is typically connected to the bottom of the box. The walls and support structures are made of a structural material, such as steel, and are sufficiently strong to withstand a cave-in of the trench. A modular hopper is positioned in the elongated rectangular opening defied between the top edges of the parallel walls; the bottom of the hopper is defined by an openable hatch or door.

A movable track and tram assembly is typically located in the bottom portion of the box. A movable grapple is connected within the box at the anterior end and a robotic joining arm is operationally connected within the box at the posterior end. A pipe segment holder/dispenser assembly is connected to one interior wall of the box and is sized to hold a plurality of pipe segments. A vibrating bar assembly is connected to the opposite interior wall of the box. A drag bar is connected to the anterior end of the top portion of the box and a control cab is connected to the opposite, posterior end of the top portion of the box.

In operation, a trackhoe digs a trench segment and drags the box into place. A pipe segment is dispensed onto the track and tram assembly by the grapple and moved into place. The pipe segment is joined to a pre-existing, already laid pipe segment by the robotic arm. After the pipe is fit in place, earth and/or stone is dropped on and around the laid pipe and the vibrating bar is deployed to further compact the stone around the pipe. The box is then drug forward by the trackhoe into the freshly-dug trench segment, with the laid pipe passing out of the box through the arch opening in the posterior wall.

Laser alignment or global positioning technology is envisioned to direct the positioning and joining of the laid pipe segments by the robot arm. The system may be constructed with varying degrees of automation, from requiring oversight and direction by an operator in the cab or in the box to fully robotic operation.

One object of the present invention is to provide an improved method and system for laying pipe in a trench. Related objects and advantages of the present invention will be apparent from the following description.

DETAILED DESCRIPTION OF THE PREFERRED EMBODIMENTS

Figure 1:
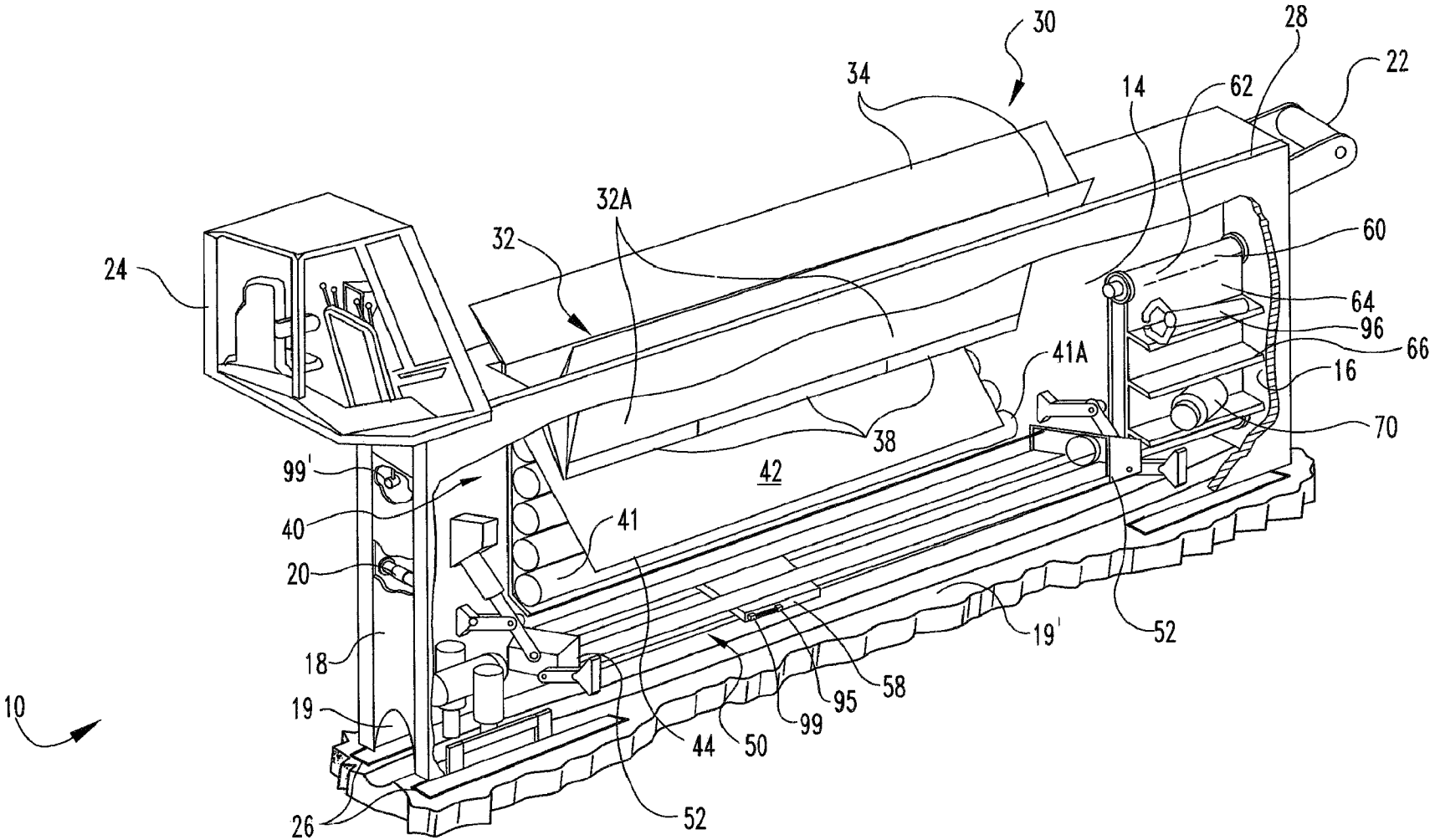
FIG. 1 is a perspective cutaway view of a first embodiment modular trench box assembly of the present invention.

For the purposes of promoting an understanding of the principles of the invention and presenting its currently understood best mode of operation, reference will now be made to the embodiments illustrated in the drawings and specific language will be used to describe the same. It will nevertheless be understood that no limitation of the scope of the invention is thereby intended, with such alterations and further modifications in the illustrated device and such further applications of the principles of the invention as illustrated therein being contemplated as would normally occur to one skilled in the art to which the invention relates.

FIGS. 1-7 relate to a first embodiment of the present invention, a modular trench box system 10 including a trench box 12 having a pair of oppositely disposed, generally parallel elongated sidewalls 14 (sometimes referred to hereinafter as simply sidewalls 14 or walls 14) separated either by a proximal endwall 16 and a distal endwall 18 extending between the sidewalls 14 or by a pair of support members or "spreaders" 20 extending between the sidewalls 14 to define an open-bottomed working volume 23. More typically, the sidewalls 14 are separated by spreaders 20 of variable length, such that the width of the trench box 12 is variable. Typically, the working volume 23 has the shape of an orthorhombic parallelepiped. The walls 14, 16, 18 and support members 20 of the trench box 12 are typically made of a durable, structural material, such as steel and define a generally open top area for receiving a modular gravel hopper 30 (sometimes referred to hereinafter as hopper module 30, hopper assembly 30, hopper portion 30, cartridge 30, stone hopper cartridge 30, and hopper system 30), a modular pipe holder 40 (sometimes referred to hereinafter as pipe hopper 40, pipe holder/dispenser/cartridge assembly 40, pipe dispenser assembly 40, pipe dispenser module 40, pipe dispensing portion 40, cartridge 40 and pipe dispenser system 40), and the like, as well as defining an aperture or generally open bottom area 19' granting access to the ground and upon which pipe segments 41 substantially the length of the trench box 12 may be dropped from the pipe hopper 40 onto the ground for connection and emplacement under gravel. More typically, the proximal and distal endwalls 16, 18 include apertures 19 formed therethrough to accommodate passage over pipe segments laid and covered within the working volume 23.

Typically, a drag bar 22 is attached to the trench box 12 and disposed such that a trackhoe or the like may more readily grab the trench box 12 and move pull it through the trench. The drag bar may or may not be unitary with one of the spreaders 20. Also, a protective enclosure or cab 24 may typically be connected to the trench box 12 as a place for an operator to work. Further, a height-adjustable skid assembly 26, may typically be connected beneath the trench box 12 for leveling the box 12 when positioned in a trench. The skid assembly 26 typically includes a length adjustable portion, such as a fluidic (hydraulic or pneumatic) cylinder or the like, that may be remotely actuated to level the trench box 12. Also typically, the top portions of the sidewalls 14 define a top edge or rim portion 28 (sometimes referred to herein as edge 28) for engaging various modular pieces of the trench box assembly 10.

Optionally, the interior of the trench box 12 may be equipped with a plurality of sensors 99 and/or cameras 99' operationally connected to a display (not shown) and/or an electronic controller 105 typically positioned in the cab 24 and available to the operator. Likewise, display outputs may be operationally connected to some or all of the cameras 99' and/or sensors 99 and disposed to be visible to operators of the excavation equipment to guide in the excavation of the trench and/or positioning of the trench box 12 therein.

Figures 2A, 2B, 2C:
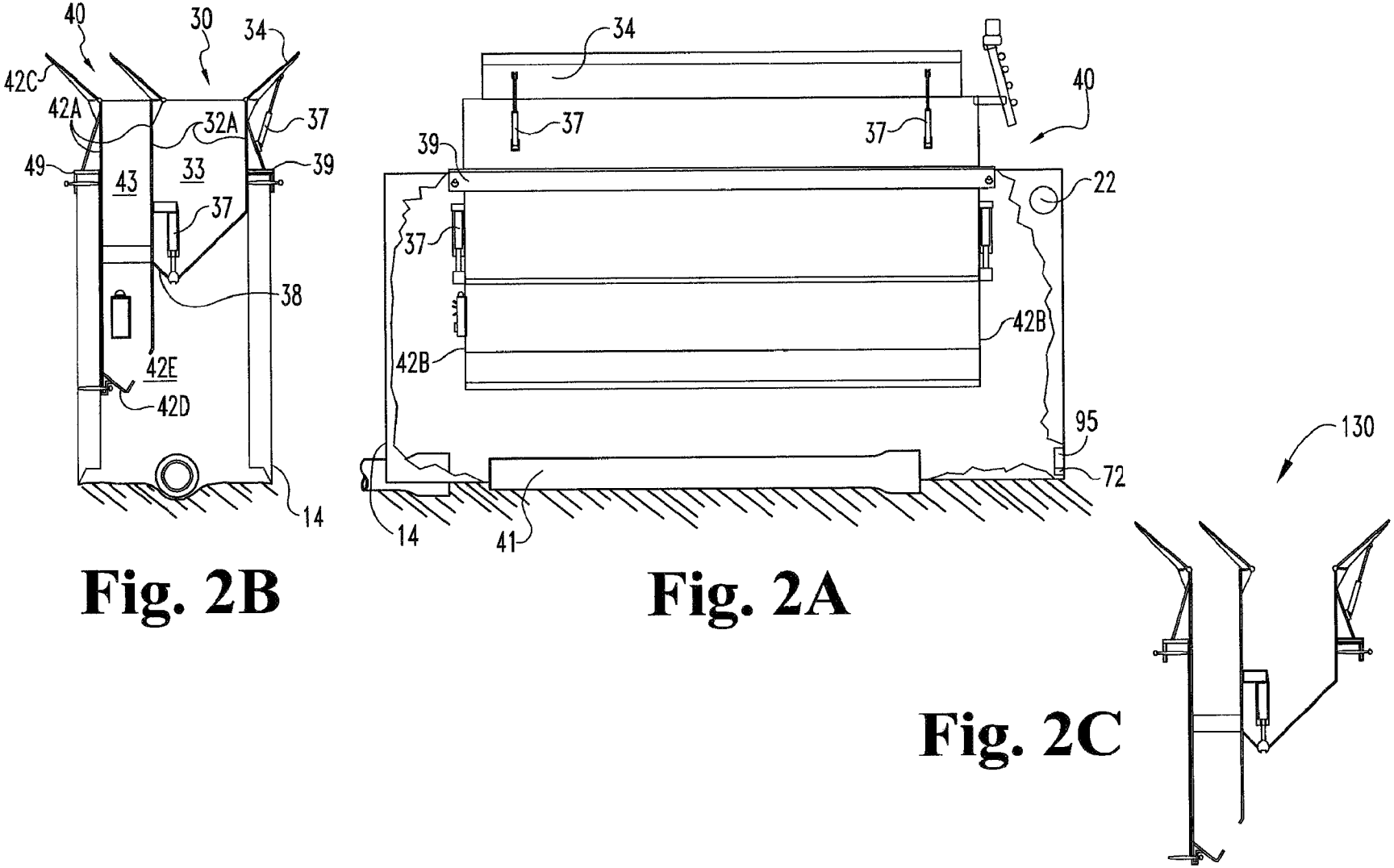
FIG. 2A is a partial front cutaway elevation view of the embodiment of FIG. 1.
FIG. 2B is a partial side cutaway elevation view of the embodiment of FIG. 1.
FIG. 2C is a partial side cutaway elevation view of an alternate cartridge including both pipe and gravel dispensers for use with the embodiment of FIG. 1.
Figure 3B:
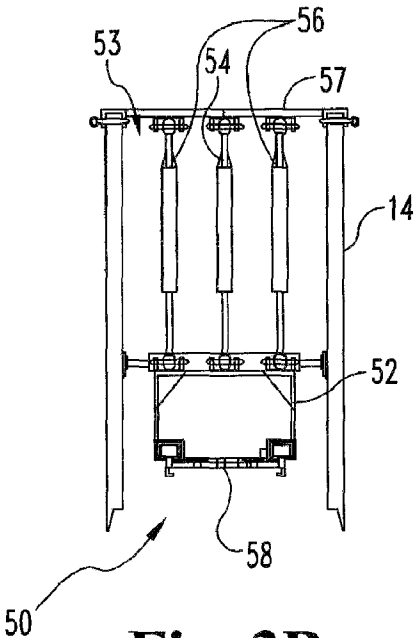
FIG. 3B is a second partial side cutaway elevation view of the embodiment of FIG. 1.
Figure 3A:
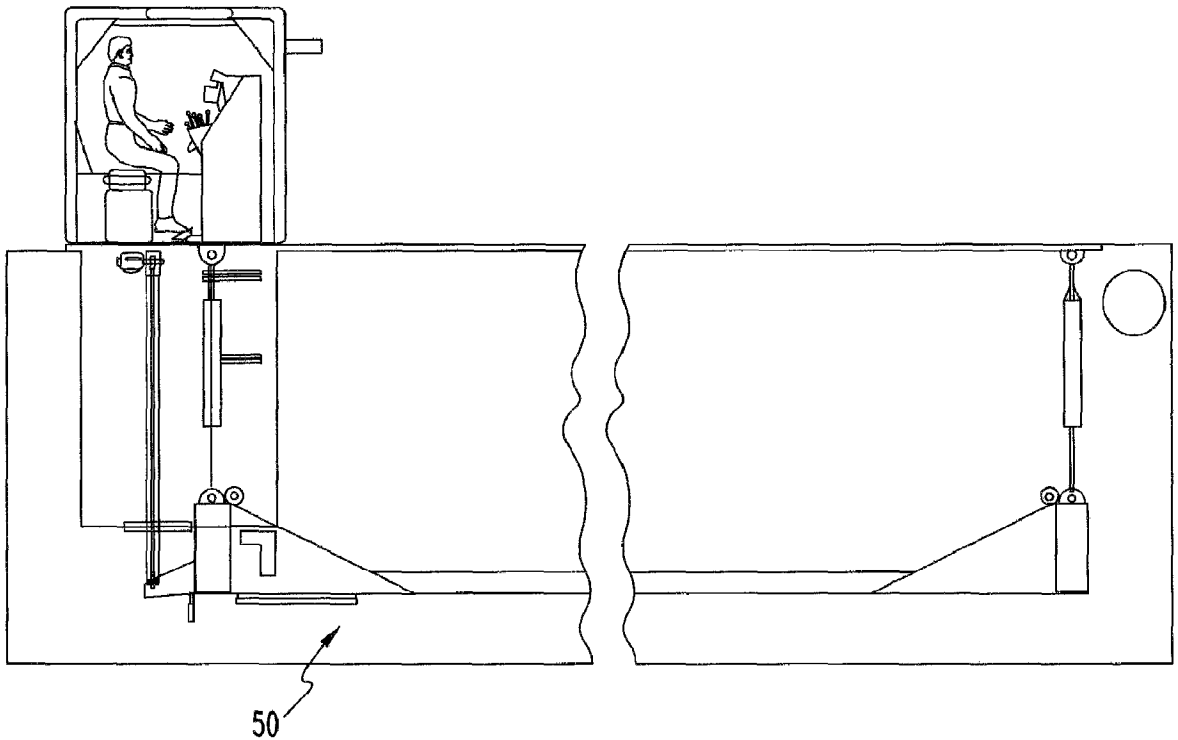
FIG. 3A is a second partial front cutaway elevation view of the embodiment of FIG. 1.
Figure 4A:
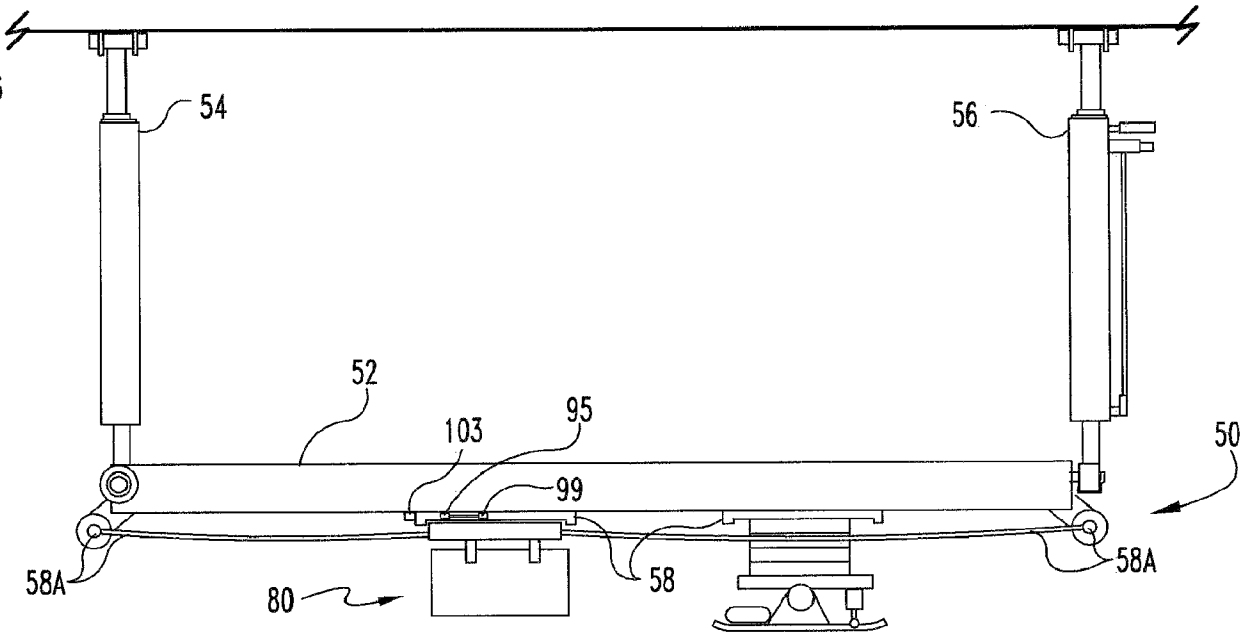
FIG. 4A is a front schematic view of the tram assembly of FIG. 1.
Figure 4B:
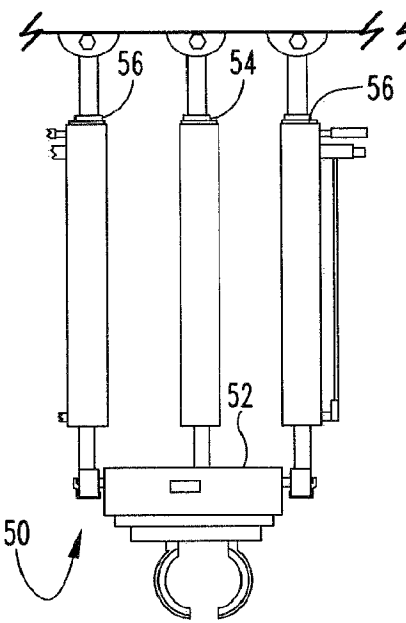
FIG. 4B is a side schematic view of the tram assembly of FIG. 4A.
Figure 4C:
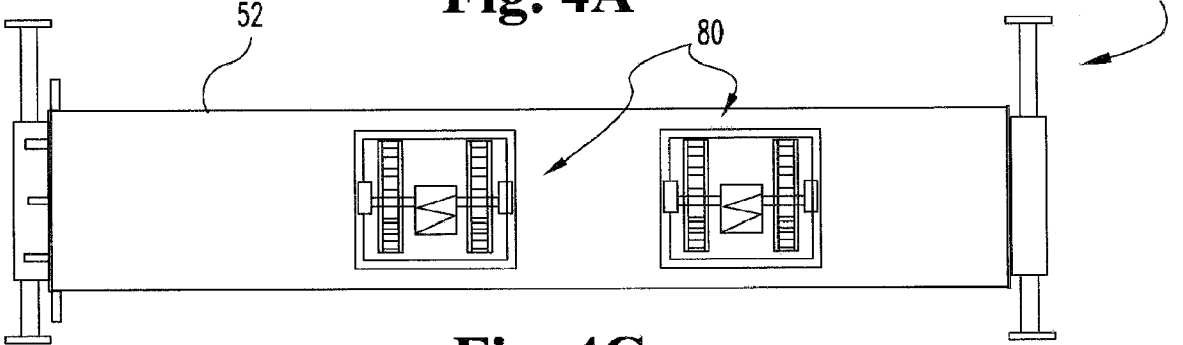
FIG. 4C is a top schematic view of the tram assembly of FIG. 4A.
Figure 4D:
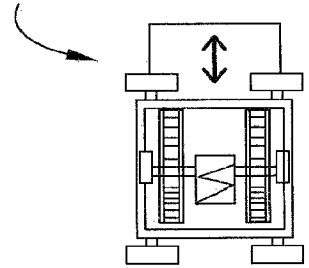
FIG. 4D is a top schematic view of the tram plate of FIG. 4C.

As seen in greater detail in FIGS. 2A-2B, the trench box assembly 10 further includes a modular gravel or stone hopper assembly or cartridge 30 sized to fit inside the trench box 12/working volume 23. The gravel hopper assembly 30 includes a gravel hopper 32 defined by a pair of generally parallel structural wall or panel members 32A, at least one and, more typically, two structural end-wall or end-panel members 32B extending between the wall panel members 32A to define a gravel storage volume 33.

The hopper module 30 typically also includes one or two top panel member 34 connected thereto (typically via a pivotable connection to a side panel 32A) and one or two bottom panel member 38 (sometimes referred to herein as bottom panel 38, bottom panel portion 38) pivotably connected between the side wall panels 32A. The bottom panel member 38 may be pivoted between a closed position (i.e., extending between the two sidewall panels 32A) and an open position (i.e., with one end distanced away from either sidewall panel 32A). One or more actuators 37 are typically operationally connected to a top and bottom panel member 34, 38 such that energization of the actuator 37 causes a respective panel member 34, 38 to pivot between an open position and a closed position. When the bottom panel 38 is pivoted into the closed position, gravel or other material may be loaded and stored in the hopper 32; when the bottom panel 38 is pivoted into an open position, gravel or the like stored in the hopper 32 may thus fall therefrom. Typically, the bottom panel portion 38 is sized and disposed such that, when in the open position, gravel is directed toward the center of the trench.

Likewise, when the top panel member(s) 34 are pivoted into an open position, the panel member(s) form a "funnel" to guide stone and gravel into the hopper 32. Further, the "funnel" defined by the open top panel members 34 may be filled with gravel to increase the load capacity of the hopper assembly 30 and thus decrease the frequency at which it must be refilled. The top and bottom panel members 34, 38 may be unitary members, or, more typically, may each comprise a plurality of independently positionable members.

The hopper assembly 30 further includes a top edge-engaging member 39 extending therefrom. Typically, the top edge-engaging member 39 extends from a sidewall panel 32A to engage the edge 28. The top edge-engaging member 39 may simply abut or may lockingly engage the edge 28.

As illustrated in greater detail in FIG. 2A-2B, the trench box system 10 also includes a modular pipe holder/dispenser cartridge/assembly 40 sized to fit into the working volume 23 inside the trench box 12. Typically, the hopper assembly 30 and the pipe dispenser assembly 40 are sized such that both assemblies 30, 40 may be simultaneously placed into a trench box 10. More typically, the assemblies 30, 40 are sized such that both may be snugly fit together in a trench box 10. The tightness of the fit of the assemblies 30, 40 into the trench box 12 may further be controlled by varying the lengths of the spreaders 20 to widen or narrow the box 12.

Much like the gravel assembly 30 discussed above, the pipe dispenser module 40 includes a pipe hopper 42 (sometimes referred to herein as hopper 42) defined by a pair of generally parallel structural wall or panel members 42A (sometimes referred to herein as parallel elongated support members 42A, side panels 42A and sidewall panels 42A), at least one and, more typically, two structural end-walls 42B (sometimes referred to herein as end-panel members 42B) extending between the wall panel members 42A to define a pipe storage volume 43. The pipe dispenser module 40 further includes a typically pivotable top member 42C connected thereto for guiding pipes thereinto and a bottom member 42D connected thereto that typically is angled to support a pipe resting thereupon and also defines a pipe dispensing aperture 42E.

The hopper 42 typically also includes at least one top member 45 connected to thereto (typically via a pivotable connection to a side panel 42A). The hopper 42 also typically includes a bottom pipe-engaging member 44 connected between the side wall panels 42A and defining a bottom pipe-dispensing aperture 42E. The bottom pipe-engaging member 44 is typically a biased latch mechanism disposed adjacent the bottom pipe-dispensing aperture 42E for engaging the bottom-most pipe in the hopper 42. The bottom pipe-engaging member 44 may be actuated to release the bottom most pipe 41 to fall into the trench and then engage the next pipe as it moves toward the bottom pipe-dispensing aperture 42E. The bottom pipe-dispensing aperture 42E is positioned such that the so-released pipe falls from the hopper assembly 40 to land in the middle of the trench, typically substantially parallel to the trench centerline.

The pipe-dispensing module 40 typically further includes a top edge-engaging member 49 extending therefrom. Typically, the top edge-engaging member 49 extends from a sidewall panel 42A to engage the top edge 28. The top edge-engaging member 49 may simply abut or may lockingly engage the top edge 28.

The trench box assembly 10 also typically houses a modular tram assembly 50 (as shown in FIGS. 3A-3B and 4A-4D). The tram assembly 50 (sometimes referred to herein as track system 50) includes a length of track 52 connected within the trench box 12 and typically extending along the major direction of elongation of the elongated walls 14. More typically, the track 52 is centered between and oriented parallel to the walls 14. In other words, the centerline of the track 52 is typically substantially unitary with the centerline of the trench.

The track 52 is typically connected to the trench box 12 by a (typically 3-dimensional) leveling/orienting assembly 53 operable to maintain the track's 52 disposition, level and slope as desired. In one typical embodiment, the leveling assembly 53 includes three fluidic cylinders or actuators 54, 56 connected between the track 52 and the trench box 12, such as to a support member 57 extending between the walls 14. Typically, the cylinders 54, 56 are connected at or near opposite ends of the track 52 with one cylinder 54 connected at or near the centerline of the track 52 and the other two cylinders 56 connected opposite each other at or near the outer edges of the track 52. In this way, the cylinders 54, 56 form a triangle or tripod relative the track 52 see FIG. 8A and the track 52 may be positioned or leveled by adjusting the length of the cylinders 54, 56 relative to one another. The cylinders 54, 56 are typically fluidically connected to a fluid pressure source and electrically connected to an electronic controller. Alternately, four or more such cylinders or support members of variable length may be connected to the track 52 for increased precision and control of the track disposition. Still alternately, a cyclical system of support members of variable length may likewise be connected to the track 52. Yet alternately, the actuators 54, 56 of the leveling assembly 53 may include one or more solenoids, electric stepping motors connected to screws, or the like.

A tram plate 58 is typically connected to the track 52 for traveling back and forth thereon. The tram plate 58 is used to support various tool modules for such tasks as moving earth, grading stone, and retrieving and positioning pipe segments expelled from the pipe dispensing assembly 40 for transport and installation/connection operations performed within the trench box 12. The track 52 typically includes a drive mechanism or tram actuator 58A such as a ring and pinion system, a chain or a belt that is operationally connected to a motor for engaging and moving the tram plate 58.

Referring back to FIG. 1, the trench box assembly 10 further typically includes a tool conveyor assembly 60 connected therein, more typically at or near one of the endwalls 16, 18, for moving tools and miscellanea vertically within the trench box 12. The tool conveyor assembly 60 typically includes a set of spaced pulleys 62 connected at predetermined positioned within the trench box 12 with a belt 64 coupled thereto, such that rotation of the pulleys 62 moves the belt 64. Alternately, a robot arm or the like may be connected on the trench box 12 to grab, position and manipulate tools and miscellanea therein. Various shelves 66 are affixed to the belt 64 for holding tools and transporting them within the trench box 12. At least one pulley 62 is typically coupled to a motor for actuating the rotation of the pulley(s) 62.

Figure 5:
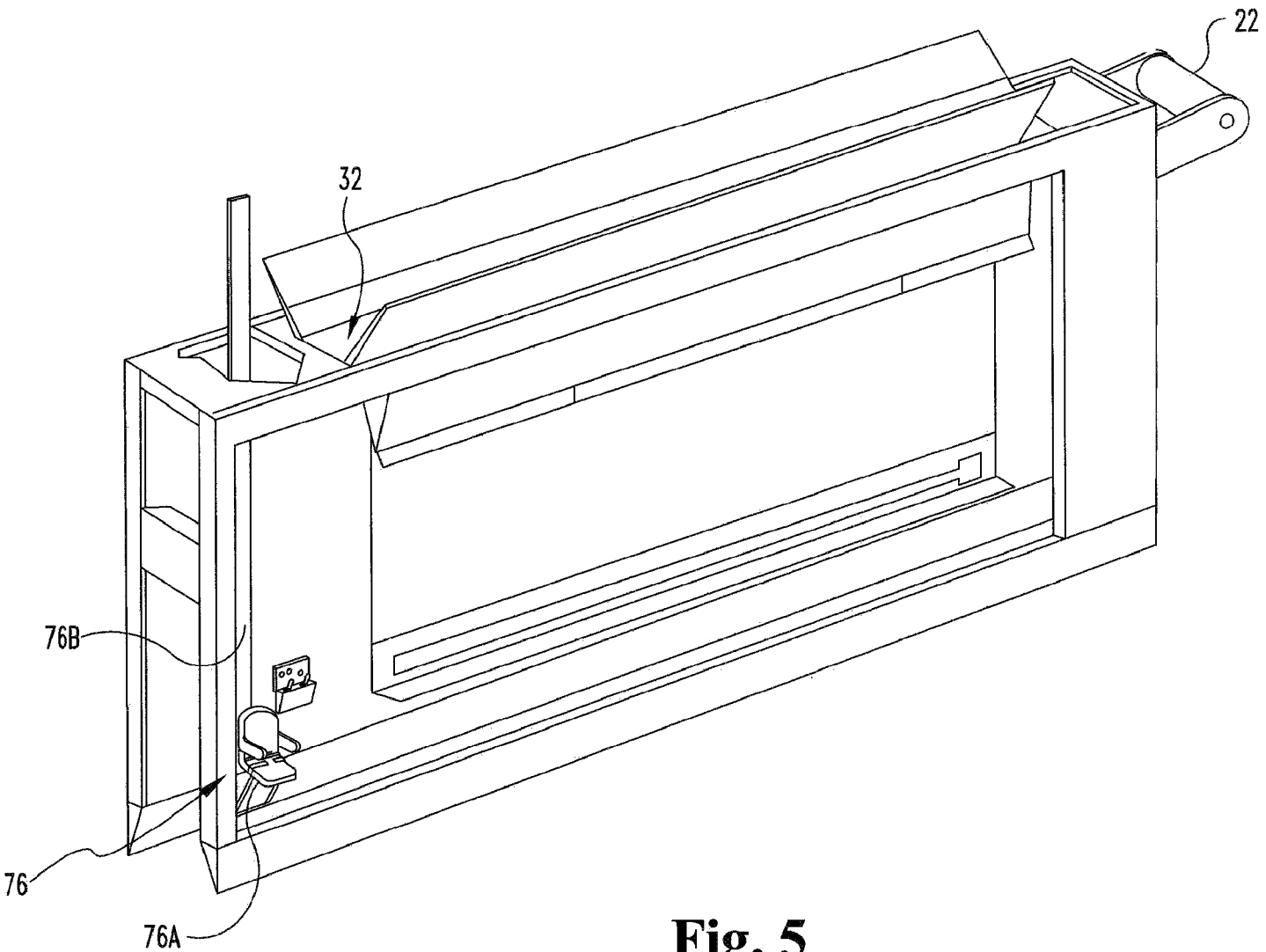
FIG. 5 is a partial perspective cutaway view of FIG. 1.
Figure 6:
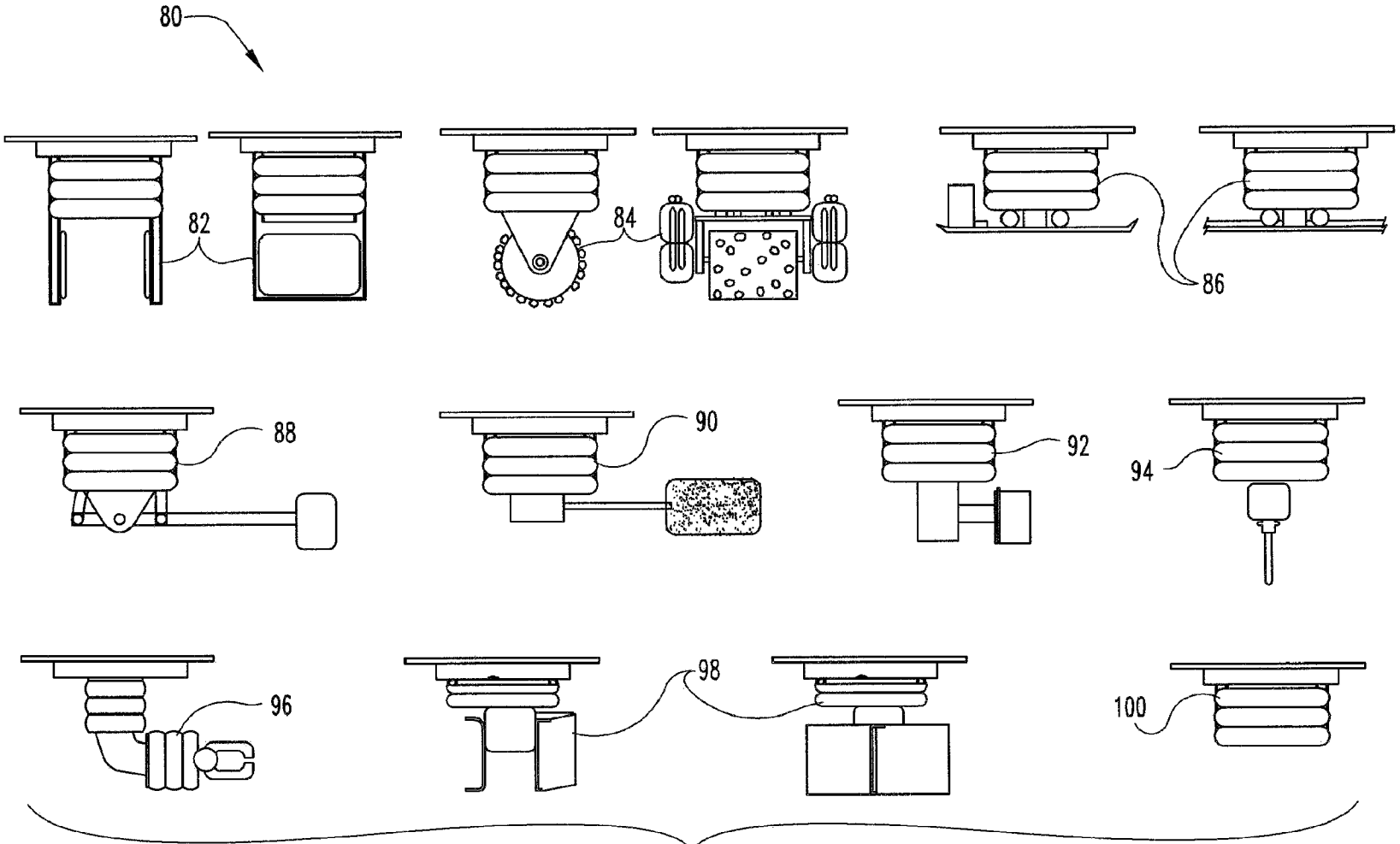
FIG. 6 is a set of schematic views of head attachments connectable to the tram plate of FIG. 4D.

As illustrated in detail in FIG. 5, the trench box assembly 10 also typically includes such tools as a stone grader 70, one or more laser targets 72 connected therein at predetermined positions, and/or a vibrating compactor bar assembly 74 operationally connected therein. Some embodiments also include a moving ladder or elevator seat assembly 76 (such as a ladder or seat 76A connected to a vertically movable track 76B) for assisting an operator entering and exiting the trench box 12.

The trench box assembly 10 also typically includes a number of modular tool attachments 80 (sometimes referred to herein as tool heads 80 and tool modules 80) connectable to the tram plate 58. (See FIG. 6). Such tool modules 80 may typically include a pipe grappler head 82, a rock cutter head 84, a compactor head 86, a hammer head 88, a pipe cleaner head 90, a tee fitter head 92, a jack hammer head 94, a robot arm head 96, a dozer blade head 98, and/or a partless adaptor head 100. Additional contemplated but not explicitly illustrated modular tool attachments include boring heads, welding heads, cutting heads, butt fusing heads and the like.

Figure 7:
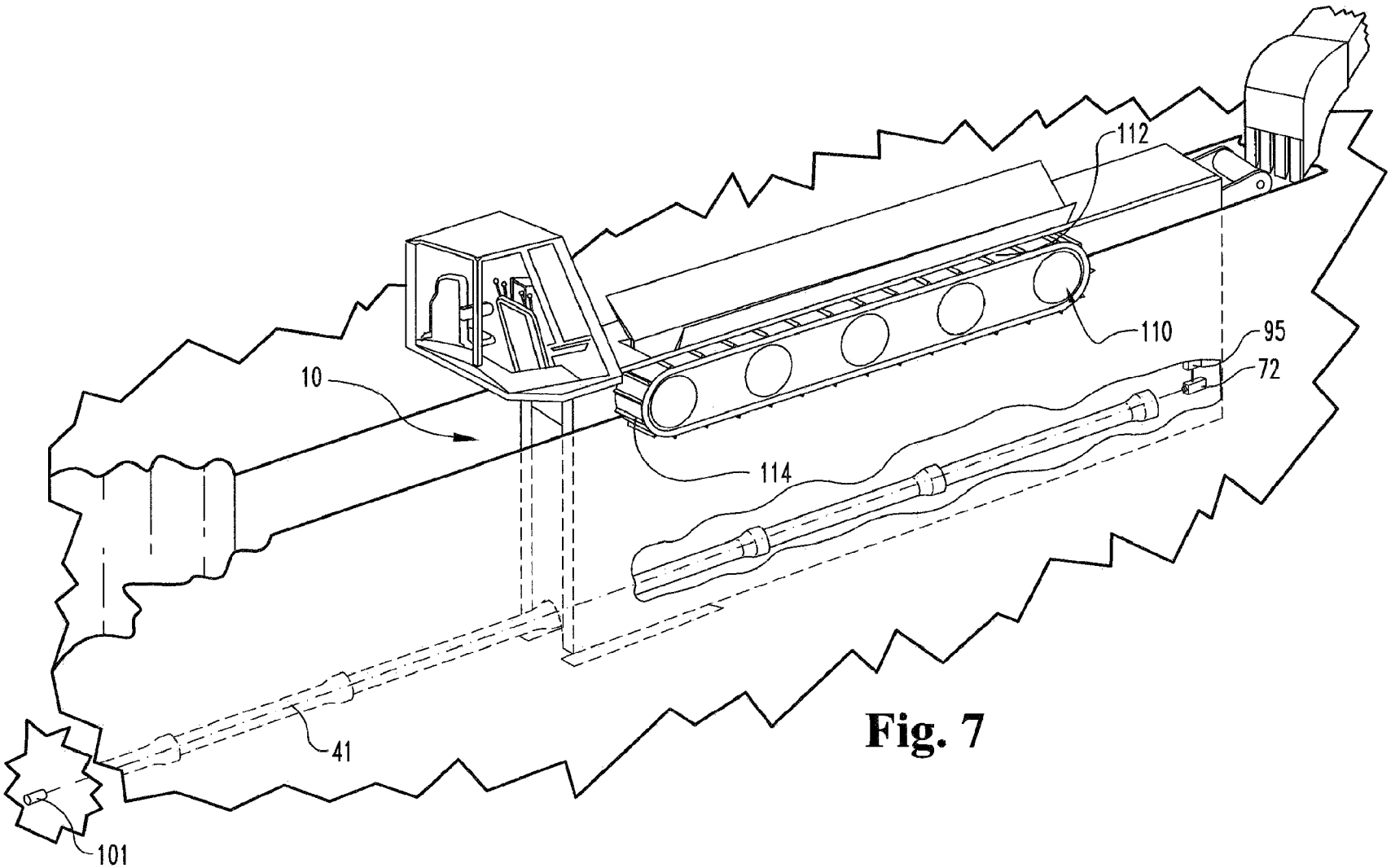
FIG. 7 is a partial perspective cutaway view of the embodiment of claim 1 with a tractor assembly connected thereto.

As illustrated in FIG. 7, the trench box 12 may be fitted with a tractor assembly 110 for independently relocating the trench box 12. The tractor assembly 110 includes a frame portion 112 connectable to the trench box 12. A pair of motive members, such as wheels or tractor treads 114 extend from the frame portion 112 on either side of the trench box 12 to engage the ground around the trench. The tractor treads 114 may be actuated to move the trench box 12 through the trench without the aid of a trackhoe or the like engaging and pulling the drag bar 22.

Typically, the hopper and pipe-dispenser modules 30, 40 are formed as a unitary cartridge 130 having a hopper portion 30 and a pipe-dispensing portion 40 that each function as described above, although each module 30, 40 may be separately formed as an independent device.

In operation, the trench box assembly 10 is positioned in a trench, such as by utilizing an excavating implement (such as a trackhoe) to lower or drag the trench box 12 into position. The trench box 12 may be preloaded with the desired cartridges 30, 40, 130 or, alternately, once the trench box 10 is in place, one or more cartridges 30, 40, 130 are inserted into the trench box 10 (typically via the excavating implement) and coupled to the top edge 28. Typically, a stone hopper cartridge 30 and a pipe-dispenser cartridge 40 (more typically in the form of the two combined as a single cartridge 130) are inserted into the trench box 12 and the trench box 12 width adjusted such that the cartridges 30, 40 snugly fit against the sidewalls 14 and each other. The edge-engaging members 39, 49 are typically locked onto the top edge 28 to hold the respective cartridges 30, 40 in place. The cartridges 30, 40 may then be loaded with stone/gravel and pipes, respectively.

Once in place and loaded, the trench box assembly 10 may be operated to lay pipe. The tram assembly 50 is positioned by actuating the leveling assembly 53 to align the track 52 with the desired pipe position. In the embodiment discussed above, this is typically accomplished by adjusting the lengths of the cylinders 54, 56 with reference to a laser beam striking the prepositioned laser targets 72 until the track 52 is positioned as desired.

Once the track 52 is disposed as desired, the tram plate 58 may be fitted with such tools as a dozer head 98, a compactor head 86 or the like and any finishing that may be required in the newly dug trench may be completed. After such operations are done, or instead of such operations if none are required, the tram plate 58 is recessed away from the central portion of the working volume 23 to make way for a pipe segment 41 to be dropped through the track 52.

Once the tram plate 58 is positioned away from the central portion of the working volume, a pipe segment 41 is dispensed from the pipe-dispensing module 40, passing through the tram assembly 50 and falling to rest on the ground. The tram plate 58 is typically fitted with a pipe grappler head 82 and moved into position over the pipe segment. The pipe grappler head 82 engages the pipe segment 41 and moves it into position for connection to an already laid pipe segment (i.e., the narrow or spigot end of the pipe is disposed for insertion into the wide or bell end 41A [sometimes referred to herein as connection bell portion 41A or joining bell 41A] of the already laid pipe). Manipulation of the pipe segment 41 into place may be done manually or with the assistance of a device such as a pipe grappler 82 or robot arm 96 connected to the tram plate 58. The pipe segment 41 is then urged into place, such as via a hammer head 88 or the like, and they 41 pipe segments joined and secured together.

Once pipe has been laid, gravel or stone may be poured from the hopper 32 into the trench box 12 to cover the laid pipe. The gravel/stone may be compacted, such as with the aid of a compactor 86 or the like. The trench box assembly 10 may then be pulled into a newly dug length of trench, such as by a trackhoe engaging the drag bar 22 and pulling the trench box assembly 10 along. Alternately, the trench box assembly 10 may be advanced through the trench under its own power, such as via the tractor assembly 110. As the trench box assembly 10 is pulled forward, the laid pipe exits through the open end of the trench box 12 or through an aperture 19 until only end of the last segment (typically belled) protrudes therethrough into the trench box 12. The cartridges 30, 40 may then be refilled, if necessary, and the pipe laying process is repeated.

Figure 8A:
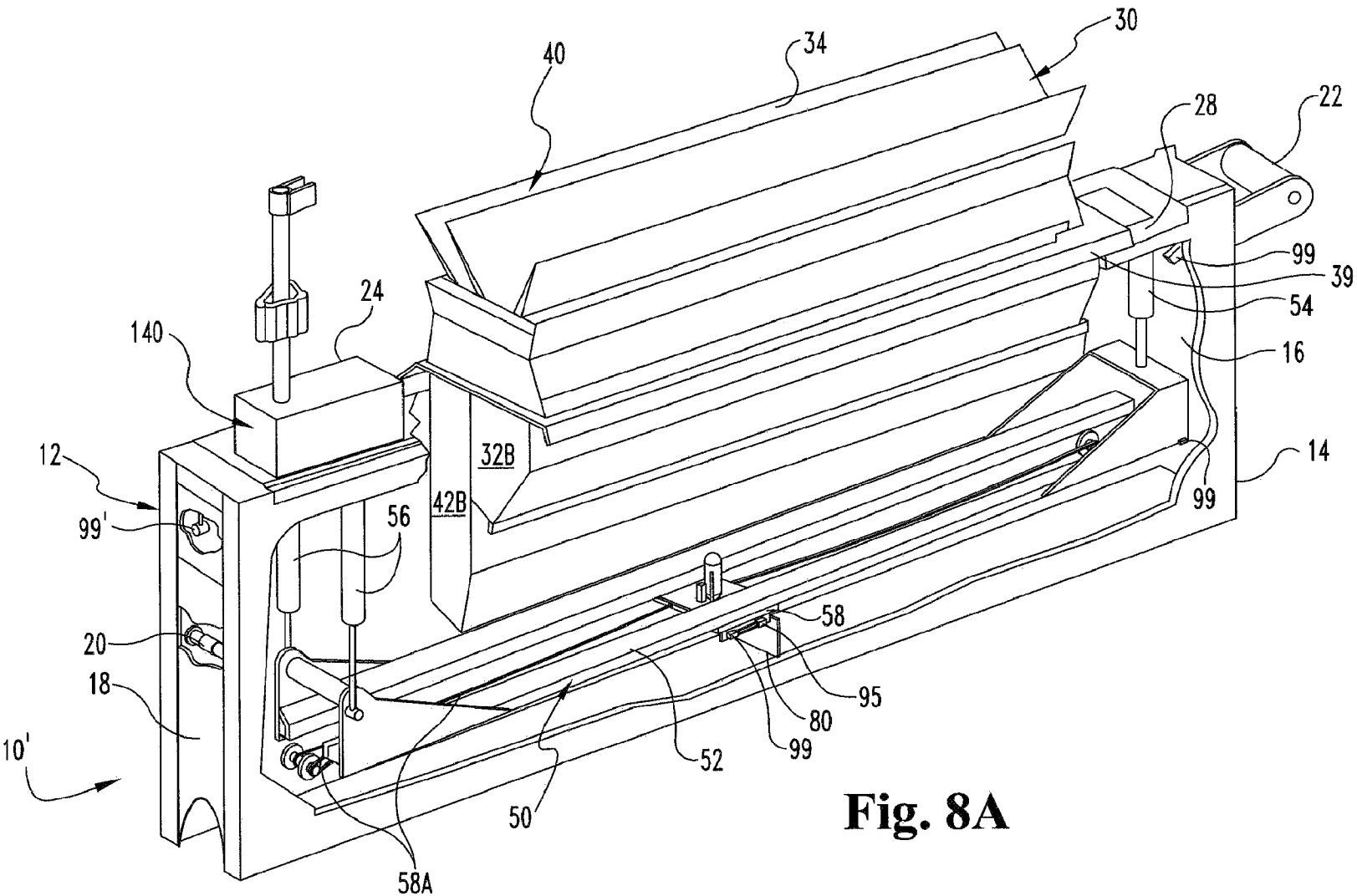
FIG. 8A is a perspective cutaway view of a second embodiment automated robotic modular trench box assembly of the present invention.
Figure 8B:
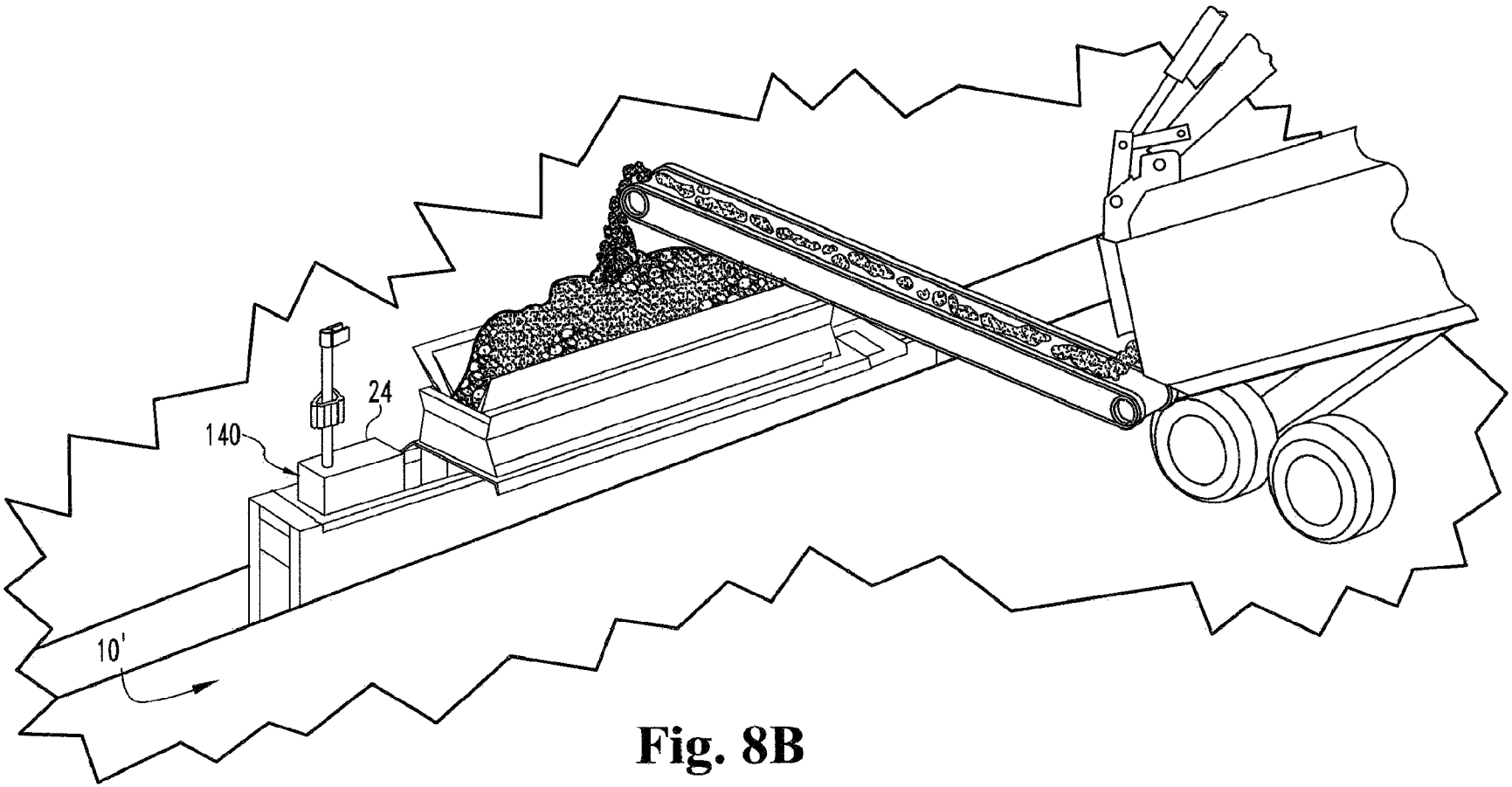
FIG. 8B is a partial perspective view of the embodiment of FIG. 8A being loaded with stone.
Figure 8C:
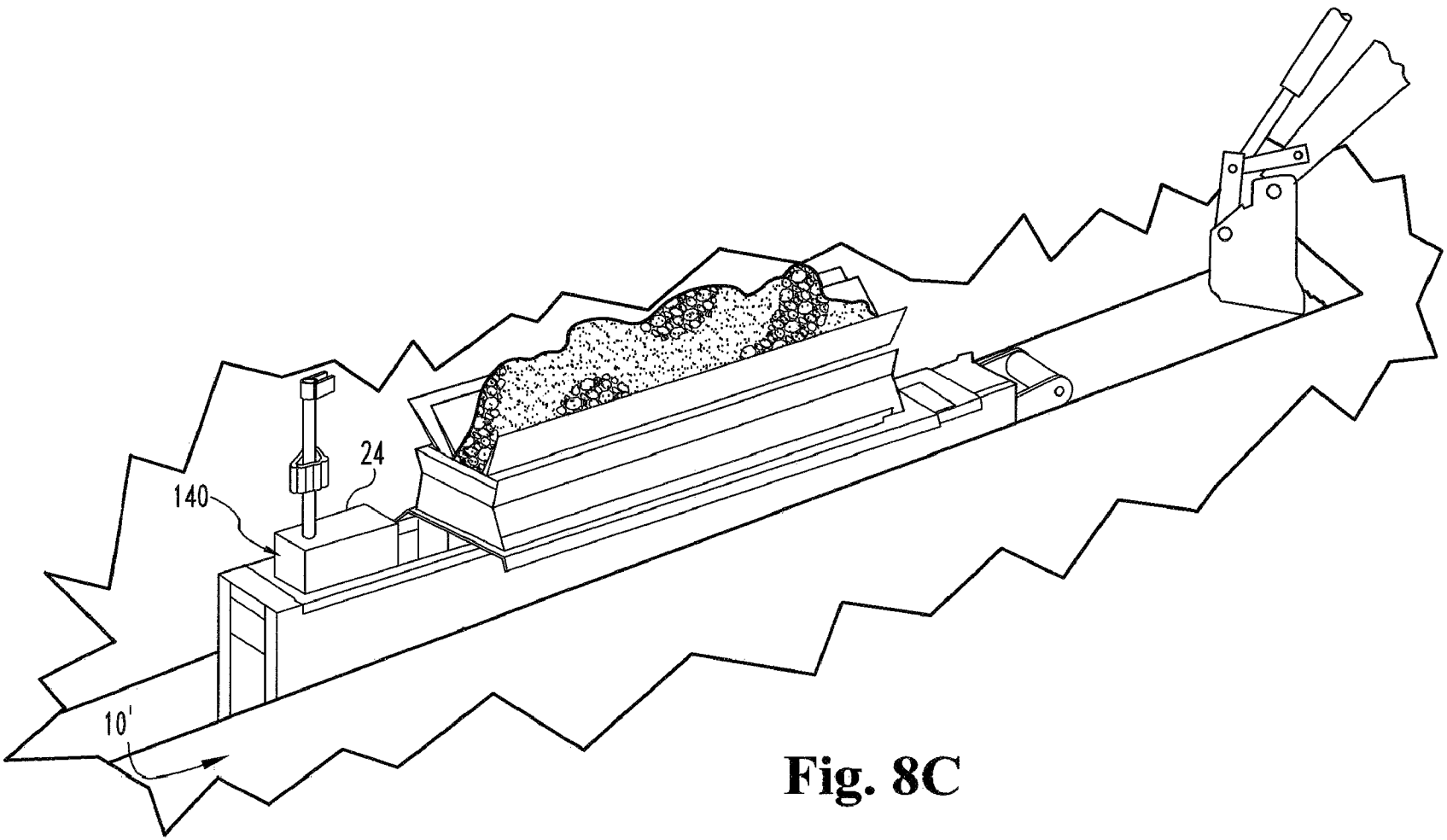
FIG. 8C is a partial perspective view of the embodiment of FIG. 8A loaded with stone.

In one alternate embodiment, as illustrated in FIGS. 8A-8C, the system 10' is similar to that described hereinabove, with the exception that the cab 24 is merely a housing for a microcontroller 140 operationally connected to the sensors and/or cameras. The system 10' is thus partially or fully automated and may be programmed to lay pipe automatically without operator assistance. In other words, the system of this embodiment is a robotic device independently capable of routine pipelaying operations.

In operation, the system 10' operates as follows. After a trench segment is dug, track, hopper and pipe dispenser systems 50, 30, 40 are connected to a trench box 12. The trench box 12 is positioned in the trench segment, the hopper system 30 is loaded with stone and the pipe dispenser system 40 is loaded with pipe segments.

The track 52 is automatically oriented at a predetermined slope, with the orientation being measured and confirmed via laser 101, global positioning system 103 data, or the like. The trench volume is typically measured, such as by laser 101, sonar, 41 or the like, and stone or earth is dropped into the trench sufficient to support a pipe segment 41 for joining to a pre-existing segment 41 or connection. If necessary, a grading or dozer head 98 is automatically connected to the tram plate 58, and the dropped stone is automatically graded. Likewise, if necessary, the stone may be compacted, such as by a compaction head 86 automatically connected to the tram plate 58 or by deployment of the compaction bar assembly 74.

The tram plate 58 is moved out of the way and a pipe segment is then automatically dispensed from the pipe dispensing assembly 40 and dropped into the trench. The pipe segment 41 is grappled by a grappler head 82 connected to the tram plate 58 and moved into a desired joining position. The desired joining position is typically determined by locating (via internal sensors) and verifying the presence of a joining bell 41A of a pre-laid pipe segment 41 or connection. The pipe segment 41 is then automatically joined, such as by connecting an appropriate joining hammer head 88 or tee-fitter head 92, or the like to the tram plate 58 and engaging the pipe segment 41 therewith. After the pipe segment 41 has been laid, more stone is automatically dropped to cover the pipe segment 41. If necessary, the stone may be graded and compacted as described above. Typically, a signal from signal generator 95 indicating the successful laying and covering of the pipe segment is generated and the trench box is then advanced trench box into a newly dug trench segment; the signal may be a visual and/or audible queue for receipt by a human trackhoe operator or may be an electronic queue for an electronic equipment operator.

While the invention has been illustrated and described in detail in the drawings and foregoing description, the same is to be considered as illustrative and not restrictive in character. It is understood that the embodiments have been shown and described in the foregoing specification in satisfaction of the best mode and enablement requirements. It is understood that one of ordinary skill in the art could readily make a nigh-infinite number of insubstantial changes and modifications to the above-described embodiments and that it would be impractical to attempt to describe all such embodiment variations in the present specification. Accordingly, it is understood that all changes and modifications that come within the spirit of the invention are desired to be protected.

What is claimed is:

1. A trench box assembly, comprising in combination:

a trench box, further comprising:

a pair of oppositely disposed parallel elongated sidewalls defining a work volume therebetween;

a pair of spaced support members extending between the sidewalls;

a drag bar operationally connected to the trench box; and a top rim operationally connected to the sidewalls;

a pipe dispensing assembly positionable within the work volume and further comprising:

a pair of oppositely disposed parallel elongated support members defining a pipe storage volume sized to hold a plurality of pipe segments therebetween;

at least one end member extending between the parallel elongated support members;

a first top rim engaging member extending from at least one of the parallel elongated support members for coupling the pipe dispensing assembly to the trench box;

a top member pivotably coupled to at least one of the parallel elongated support members; and a bottom member extending at least partially between the parallel elongated support members and defining a pipe dispensing aperture;

a gravel hopper assembly positionable within the work volume and further comprising:

a pair of oppositely disposed parallel elongated side panels defining a gravel storage volume therebetween;

at least one end panel extending between the side panels;

a second top rim engaging member extending from at least one of the parallel elongated support members for coupling the pipe dispensing assembly to the trench box;

a top panel pivotably coupled to one of the side panels;

a bottom panel pivotably coupled to one of the side panels and sized to extend between the side panels; and an actuator operationally coupled to the bottom panel;

wherein energization of the actuator pivots the bottom panel between a first position and a second position;

a service tram assembly positioned in the work volume and further comprising:

a track positioned between the pair of oppositely disposed parallel elongated sidewalls;

at least one track support member extending between the sidewalls;

a plurality of spaced apart fluidic actuators extending between the track and the at least one track support member;

a tram connecting plate operationally connected to the track and movable along the track;

a tram actuator coupled to the track and energizable to move the tram connecting plate along the track; and a tool module operationally connectable to the tram connecting plate;

wherein the fluidic actuators are energizable to adjust a position of the track;

wherein the trench box defines a substantially open bottom area; and wherein the pipe dispensing assembly deposits pipe directly onto the ground.

2. The assembly of claim 1 and further comprising a tool conveyor assembly for vertically moving tools connected in the work volume.

3. The assembly of claim 1 and further comprising a pipe grappler assembly for manipulating pipe segments connected in the work volume.

4. The assembly of claim 1 and further comprising a stone grader assembly connected in the work volume.

5. The assembly of claim 1 and further comprising:

a cab enclosure connected to the top rim;

a controller connected in the cab enclosure;

a first set of sensors operationally connected to the controller and positioned in the pipe dispensing assembly;

a second set of sensors operationally connected to the controller and positioned in the gravel hopper assembly;

a third set of sensors operationally connected to the controller and positioned in the service tram assembly;

wherein the controller is operationally connected to the panel actuator, the fluidic actuators and to the tram actuator.

6. The assembly of claim 1 and further comprising pivoting actuators operationally coupled to the top member, the top panel and the bottom panel, respectively.

7. The assembly of claim 6 wherein the pivoting actuators are hydraulic cylinder assemblies.

8. The assembly of claim 1 wherein the tool module is selected from the group consisting of pipe grappler, rock cutter, compactor, pipe cleaner, sledge hammer, tee fitter, jack hammer, dozer blade, and robot arm.

9. The assembly of claim 1 wherein the plurality of spaced apart fluidic actuators includes three actuators, wherein two of the actuators are connected to the track and positioned opposite the track from each other, and wherein the third actuator is spaced down the track from the other two.

10. A trench box device, comprising in combination:

a pair of oppositely disposed parallel elongated sidewalls, each wall having a proximal end and a distal end and defining a substantially bottomless work volume therebetween;

a distal track support member extending between the sidewalls;

a proximal track support member extending between the sidewalls;

a track positioned between the pair of oppositely disposed parallel elongated sidewalls;

a first track adjusting member extending between the track and the distal track support member;

a second track adjusting member extending between the track and the distal track support member;

a third track adjusting member extending between the track and the proximal track support member;

a tram connecting plate operationally connected to the track and movable along the track;

a tram actuator coupled to the track and energizable to move the tram connecting plate along the track; and a tool module operationally connectable to the tram connecting plate;

wherein the track is positioned between the first and second track adjusting members;

wherein the first, the second, and the third track adjusting members are energizable to level the track.

11. The device of claim 10 wherein the track adjusting members are fluidic cylinders.

12. The device of claim 10 wherein the track adjusting members are solenoids.

13. The device of claim 10 wherein the tool module is selected from the group consisting of pipe grappler, rock cutter, compactor, pipe cleaner, sledge hammer, tee fitter, jack hammer, dozer blade, and robot arm.

14. A modular trench box apparatus, comprising in combination:

a trench box defining an open bottomed work volume therein;

a drag bar operationally connected to the trench box; and a top rim operationally connected to the trench box;

a pipe dispensing module positionable within the work volume and further comprising:

a pair of oppositely disposed parallel elongated support members defining a pipe storage volume therebetween;

at least one end member extending between the elongated support members;

a first top rim engaging member extending from a respective elongated support member for coupling the pipe dispensing module to the trench box; and a bottom member extending at least partially between the elongated support members and defining a pipe dispensing aperture;

a gravel hopper module positionable within the work volume and further comprising:

a pair of oppositely disposed parallel elongated side panels defining a gravel storage volume therebetween;

at least one end panel extending between the side panels;

a second top rim engaging member extending from a respective elongated support member for coupling the pipe dispensing module to the trench box;

a bottom panel pivotably coupled to one of the side panels and sized to extend between the side panels; and an actuator operationally coupled to the bottom panel;

wherein the pipe dispensing module is sized to hold a plurality of pipe segments;

wherein energization of the actuator pivots the bottom panel between a first position and a second position.

15. A modular gravel hopper and pipe-dispenser assembly for use in a trench box apparatus, comprising in combination:

a pipe dispensing module for holding and dispensing a plurality of pipe segments positionable within the trench box and further comprising:

a pair of oppositely disposed parallel elongated support members defining a pipe storage volume therebetween;

at least one end member extending between the elongated support members;

a first top rim engaging member extending from one of the elongated support members for coupling the pipe dispensing module to the trench box; and a bottom member extending at least partially between the elongated support members and defining a pipe dispensing aperture;

a gravel hopper module connected to the pipe-dispensing module and further comprising:

a pair of oppositely disposed parallel elongated side panels defining a gravel storage volume therebetween;

at least one end panel extending between the side panels;

a second top rim engaging member extending from one of the support members for coupling the pipe dispensing module to the trench box;

a bottom panel pivotably coupled to one of the side panels and sized to extend between the side panels; and an actuator operationally coupled to the bottom panel;

wherein energization of the actuator pivots the bottom panel between a first position and a second position.

16. The modular gravel hopper and pipe-dispenser assembly of claim 15 wherein a respective elongated support member is unitary with a respective elongated side panel.

17. A method of laying pipe in a trench, comprising:

a) digging a trench segment;

b) connecting the modular hopper and pipe dispenser assembly as recited in claim 16 to a trench box;

c) positioning the trench box in the trench segment;

d) loading the hopper module with stone;

e) loading the pipe dispensing module with pipe segments;

f) orienting a track at a predetermined slope;

g) dropping the stone into the trench;

h) grading the stone;

i) dropping one of the pipe segments into the trench;

j) grappling one of the pipe segments;

k) moving one of the pipe segments into desired joining position;

l) joining adjacent pipe segments;

m) covering the joined pipe segment with the stone; and n) advancing the trench box into a newly dug trench segment.

18. The method of claim 17, further comprising:

o) connecting a compaction head to the track; and p) compacting the stone.

19. The method of claim 17 wherein step f) includes calibrating the track orientation with lasers.

20. The method of claim 17 wherein step f) includes calibrating the track orientation using a global positioning system.

21. The method of claim 17, and further comprising:

q) connecting a dozer head to the track; and r) grading the trench.

22. The method of claim 17, and further comprising:

s) before g), measuring a volume of the trench; and t) calculating an amount of stone required to sufficiently fill the trench to support one of the pipe segments for joining.

23. The method of claim 17, and further comprising:

u) before j), connecting a grappler head to the track.

24. The method of claim 17, and further comprising:

v) before k), locating a connection bell portion of a previously laid pipe segment; and w) before m), verifying a previously laid pipe segment is positioned at desired grade.

25. The method of claim 17, and further comprising:

x) after m) and before n), generating a signal indicative of successful completion of m).

* * * * *